US009824557B2

(12) United States Patent
Mainetti

(10) Patent No.: US 9,824,557 B2
(45) Date of Patent: Nov. 21, 2017

(54) ANTI-SHOPLIFTING PLATE WITH ALARMING LIQUID

(71) Applicant: MAINETTI S.P.A., Castelgomberto (Vicenza) (IT)

(72) Inventor: Mario Mainetti, Valdagno (IT)

(73) Assignee: MAINETTI S.P.A., Castelgomberto (Vicenza) (IT)

( * ) Notice: Subject to any disclaimer, the term of this patent is extended or adjusted under 35 U.S.C. 154(b) by 0 days.

(21) Appl. No.: 15/245,555

(22) Filed: Aug. 24, 2016

(65) Prior Publication Data

US 2017/0109982 A1 Apr. 20, 2017

(30) Foreign Application Priority Data

Oct. 16, 2015 (IT) ..... 102015000062581

(51) Int. Cl.
*G08B 13/14* (2006.01)
*G08B 13/06* (2006.01)
*G06Q 99/00* (2006.01)

(52) U.S. Cl.
CPC ..... *G08B 13/06* (2013.01); *G06Q 99/00* (2013.01)

(58) Field of Classification Search
CPC ..... E05B 73/0017; E05B 39/002; Y10T 70/5004; Y10T 24/50; G08B 13/2434
USPC ..... 340/572.1, 572.8, 568.1, 571; 70/57.1
See application file for complete search history.

(56) References Cited

U.S. PATENT DOCUMENTS 2,593,441 A * 4/1952 Hager ..... A45C 11/324 70/456 R
4,698,620 A * 10/1987 Marshall ..... E05B 73/0017 340/568.2
5,309,740 A * 5/1994 Hansen ..... E05B 73/0017 24/704.1
5,852,856 A * 12/1998 Seidel ..... E05B 73/0017 24/704.1
7,652,574 B2 * 1/2010 Sayegh ..... E05B 73/0017 340/568.1

(Continued)

FOREIGN PATENT DOCUMENTS

DE 9111503.5 U1 12/1991

OTHER PUBLICATIONS

European Search Report dated Jun. 8, 2016, from the corresponding European Application.

(Continued)

*Primary Examiner* — Eric M Blount
(74) *Attorney, Agent, or Firm* — Katten Muchin Rosenman LLP

(57) ABSTRACT

An anti-shoplifting plate with an alarming liquid is used on an anti-theft device of the type called "pin". The plate is composed of a lid and a base, as well as by a nail, which includes a head and a needle. The needle penetrates a bulb, n the plate where one or more vials are positioned and contain colored alarming liquid that, in the case of a break-in attempt, release the liquid contained causing the coloring of the product and making it unusable and dirtying the hands of those trying to tamper with it. Such a plate is provided for a conformation of the seat to accommodate the vials on the base that allows adjusting the effort required to cause the breakage of said vials when a break-in attempt is made on the anti-theft device by a dishonest person.

7 Claims, 3 Drawing Sheets

(56) References Cited

U.S. PATENT DOCUMENTS

| | | | | |
|---|---|---|---|---|
| 7,961,100 | B2 * | 6/2011 | Wyatt, Jr. | E05B 73/0017 340/568.1 |
| 2011/0050427 | A1 * | 3/2011 | Skjellerup | E05B 73/0017 340/572.8 |
| 2016/0177597 | A1 * | 6/2016 | Mainetti | E05B 73/0017 24/453 |

OTHER PUBLICATIONS

European Written Opinion dated Jun. 8, 2016, from the corresponding European Application.

* cited by examiner 1
2
3
4
100
P 2
10
100
4

3
9
10
13
4
100

2
30
3
10
7
4

2
8
7
12
10
11
3
13
6
5
4

ANTI-SHOPLIFTING PLATE WITH ALARMING LIQUID

BACKGROUND OF THE INVENTION

1. Field of the Invention

The present invention is directed to an anti-shoplifting plate with an alarming liquid.

2. Discussion of the Related Art

Among the various anti-shoplifting devices there are those of the type commonly called "pin", which are widely used, in particular in the field of clothing.

Such devices consist of two separate elements substantially in the form of a first closure element, commonly called "nail", composed of a head from which a needle projects and by a second closure element, commonly called "plate"; such two elements are held together when the needle, after it has been slotted in and projects from the product to be protected, is inserted in the plate, where it is blocked.

Basically, a minimal portion of the product equipped with anti-shoplifting device, such as a fabric, a sweater, an item of clothing or other, is sandwiched and blocked between the needle-carrying head of the nail and the base of the locking plate of the needle inserted in it, where it is held through anti-withdrawal means, which can only be disinserted through special tools in the possession of authorised workers, such as the cashiers of shops selling the products equipped with the aforementioned anti-theft device.

In order to increase theft-deterrent power it is foreseen to insert, inside the needle-locking plate, one or more vials containing a coloured liquid, commonly defined with the generic term "ink", which, in the case of forcing of the anti-theft device by a dishonest person, who attempts to detach the "nail" from the "plate", break, releasing the liquid, which indelibly stains the garment protected with the anti-shoplifting device, as well as the hands of the person tampering with said anti-shoplifting device in a clearly visible manner.

In the current state of the art there are numerous types of anti-shoplifting plates equipped with vials containing coloured alarming liquid which, whilst achieving their task, in practice have some drawbacks, such as to make them not always suitable to use for the type of product protected with the anti-shoplifting device.

The most significant documents of the state of the art are: US 2011/050427 A1, U.S. Pat. No. 5,309,740 A, DE 9111503 U1 and U.S. Pat. No. 5,852,856 A.

In practice, one of the drawbacks of known anti-shoplifting devices is often that of having substantial resistance to tampering (operation that consists of attempting to detach the nail from the plate); said resistance advantageously prevents the anti-theft device from being broken, but also forces the dishonest person to act with force, to achieve his/her fraudulent activity, with the consequence of damaging, not always clearly, but in any case substantially, the protected garment, which thus loses its commercial value.

Conversely, when the resistance to tampering is weak, even a minimal breaking action by a dishonest person is sufficient to cause the vials to break, so that the liquid contained in them, coming out, dirties the hands of the person but, particularly, colours the protected garment, with the consequence of thus having numerous damaged products with substantial frequency; this usually happens in clothes shops of department stores, where low-cost garments are displayed.

SUMMARY OF THE INVENTION

The purpose of the present invention is to make an anti-shoplifting plate with alarming ink, to be used in anti-shoplifting devices of the "pin" type, which does not have the drawbacks of similar known products.

Specifically, the purpose of the invention is to make an anti-shoplifting plate equipped with one or more vials of alarming ink, where it is possible to calibrate the breaking force of said vials, caused by an attempt to tamper with the anti-shoplifting device, so as to adapt the function of the anti-shoplifting device to the type of product on which it is applied.

Such a purpose is accomplished by foreseeing that a portion with reduced thickness is created on the base of the plate containing the vials of alarming liquid, so as to make it easier to break in the case of deliberate tampering with the anti-theft device.

With such a constructive solution, i.e. with the possibility of varying the thickness of a narrow portion of the plate, it is thus also possible to determine the effort needed to break firstly the base of the plate and, consequently, to break the vials containing the dye.

BRIEF DESCRIPTION OF THE FIGURES

The invention will be defined more clearly through the description of some possible embodiments thereof, given as a non-limiting example, with the help of the attached tables of drawings, where.

DETAILED DESCRIPTION OF THE INVENTION

Figures 1, 2, 3, 4, 5:
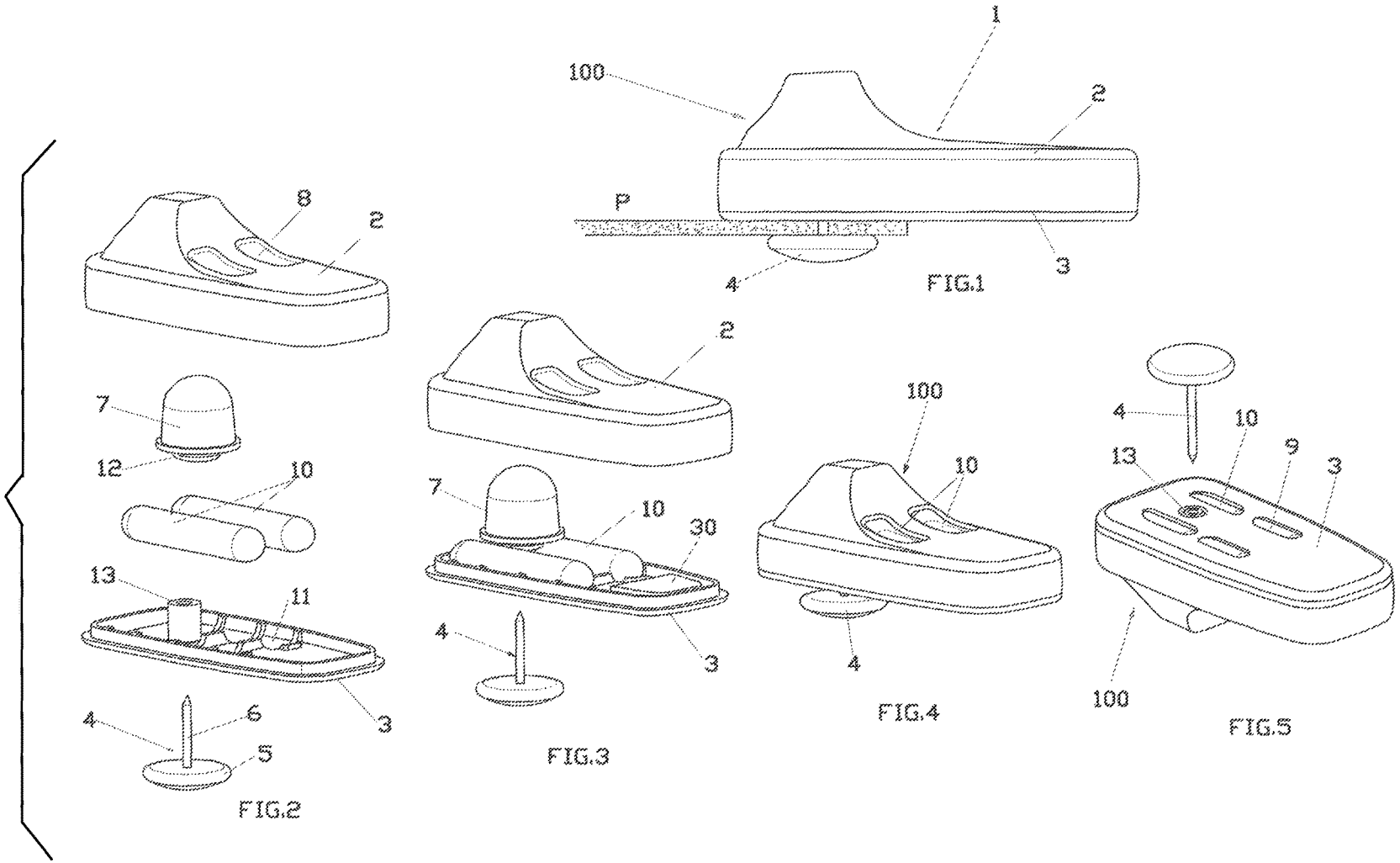
FIG. 1 (table I) represents a front view of a common anti-theft device applied to the product to be protected.
FIGS. 2 and 3 represent two exploded views of the anti-theft device equipped with dye vials, made according to the invention.
FIGS. 4 and 5 represent two perspective views, upper and lower respectively, of the anti-theft device according to the invention.
Figure 9:
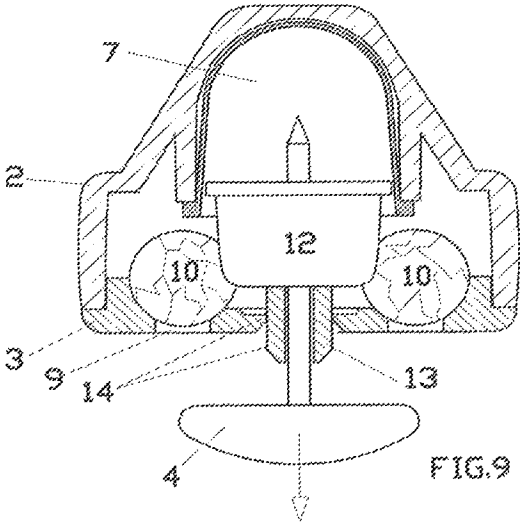
FIG. 9 represents a section view during breaking of the vials.
Figure 11:
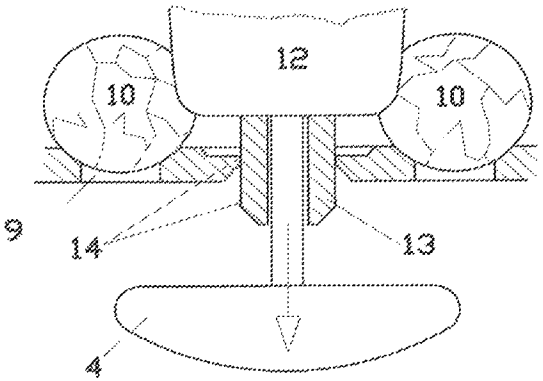
FIGS. 10 and 11 represent two detailed views, at rest and after breaking respectively, of the anti-theft device according to the invention.
Figure 8:
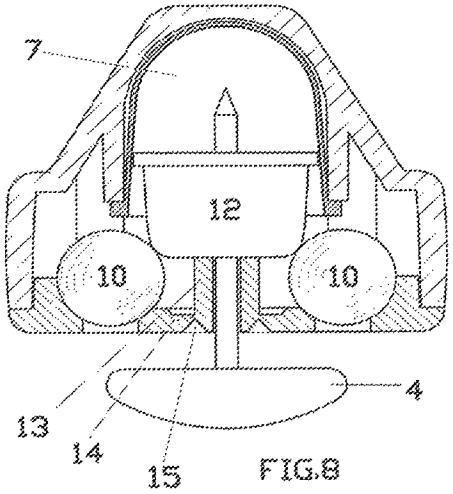
FIGS. 7 and 8 represent two section views of the device according to the invention, respectively carried out according to the lines VII-VII and VIII-VII of FIG. 6.
Figure 10:
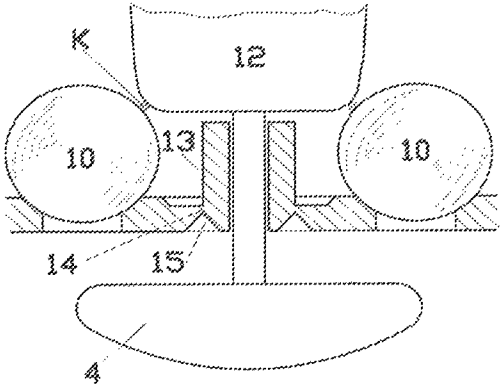
Figure 7:
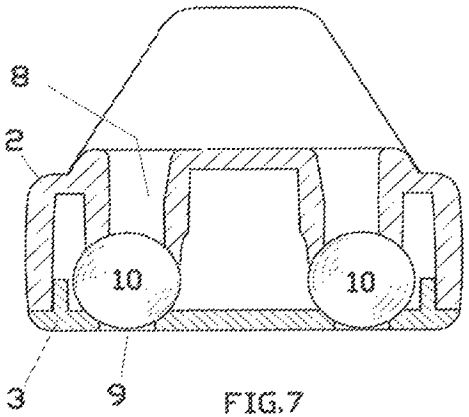
Figure 6:
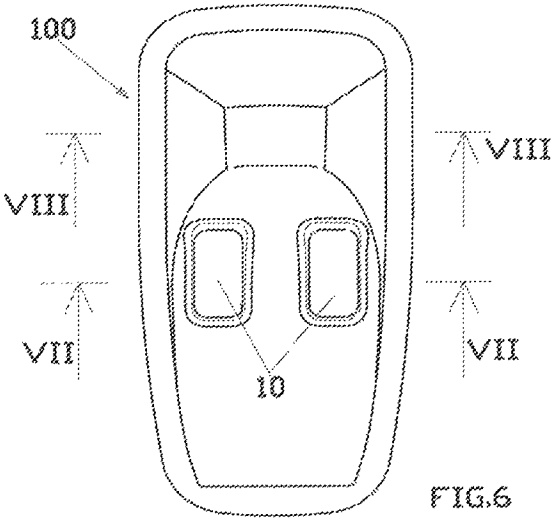
FIG. 6 (table II) represents a plan view of the anti-theft device according to the invention.

As can be seen from the figures, the anti-theft device of the "pin" type, wholly indicated with reference numeral 100, consists of a plate 1, composed by a lid 2 and a base 3 and by a nail 4, composed by a head 5 and a needle 6; said needle 6 penetrates into a bulb 7, contained in the plate 1, which is equipped with anti-withdrawal means that hold said needle, so as to keep a portion of the product "P" to be protected sandwiched between the base 3 and the head 5. Moreover, again positioned inside the plate 1, in addition to an electric alarm circuit 30, there is also one or more vials 10, containing the alarming liquid that can be seen through slits 8, present on the lid 2, that, in the case of attempted break-in, to detach the nail 4 from the plate 1, break, releasing the liquid contained that, through the slits 9, formed on the base 3 of the plate, colours the product "P" by impregnation and the hands of the person by pouring, all as per se known.

Inside the plate (1) is positioned, in addition to an electric circuit alarm (30), also one or more vials (10), visible through slots (8), on the lid (2), containing coloured alarming liquid that, in case of a break-in attempt, to detach the nail (4) from the plate (1), break, releasing the contained liquid which, through slots (9), formed on the base (3), and through the slots (8), on the lid (2), causes the colouring of the product (P) making it unusable and dirtying the hands of those who try to tamper it, said plate (1) being characterized in that it is provided for a conformation of a seat (11) to accommodate the vials (10) on the base (3) that allows to adjust the effort required to cause the breakage of said vials (10) when is made a break-in attempt on the anti-theft device (100) by a prowler, said breakage action being practiced directly by a lower projecting metal shank (12) contained in the bulb (7).

The novel characteristic of the invention consists of the special conformation of the seat for accommodating the vials 10 on the base 3 that allows, as well as the breaking of the vials, also to adjust the minimum effort needed to cause such breaking, when a breaking-in action is exerted on the anti-theft device by a dishonest person.

As can be seen in the detailed views, the two vials 10, positioned and held in the seats 11 formed on the base 3, are also arranged in contact with the projecting lower metallic tang 12 of the bulb 7; such a tang 12 also rests on a projecting hub 13, which constitutes a single body with the base 3 and is held on said base through a narrow section 14, formed through at least one weakening notch 15, the thickness of said section being "calibrated" as a function of the force required to cause the vials to break.

In practice, as can be seen from observing the figures, the action of a dishonest person, attempting to detach the nail 4 from the plate 1, to eliminate the alarm action of the anti-theft device 100, for example by introducing a blade between the base 3 and the head 5, is resisted until the force exerted is sufficient to detach the hub 13 from the base 3, breaking the narrow section 14, so as to allow the metallic tang 12 to descend, which, in the contact area "K" with the vials 10, exerts a compression force with the consequent breaking of said vials 10 and release of the alarming coloured liquid from the slits 9 present on the base 3 and from the slits 8 present on the lid 2.

In particular, the breaking action of the vials 10 is facilitated by the fact that the lower tang 12 has a frusto-conical conformation, so that the contact area "K" with the curved surface of the vial 10 reduces to a point-type and tangent contact, where the entire breaking force is concentrated.

Figure 12:
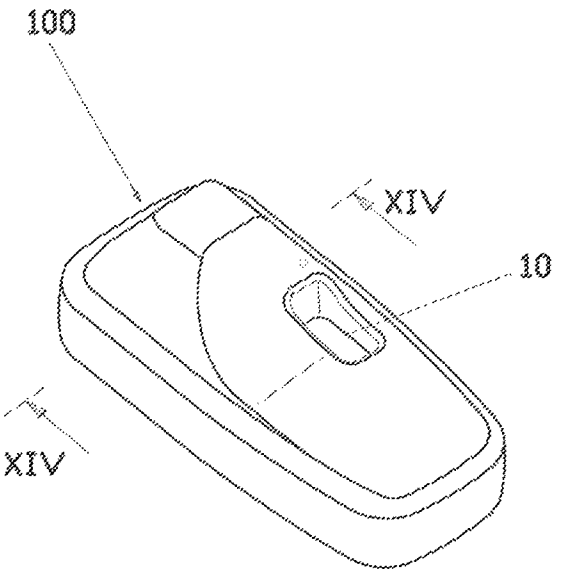
FIGS. 12, 13, and 14 (table III) represent three views—perspective, of the base and in section respectively, carried out according to the line XIV-XIV of FIG. 12—of a device according to the invention equipped with a single vial.
Figure 13:
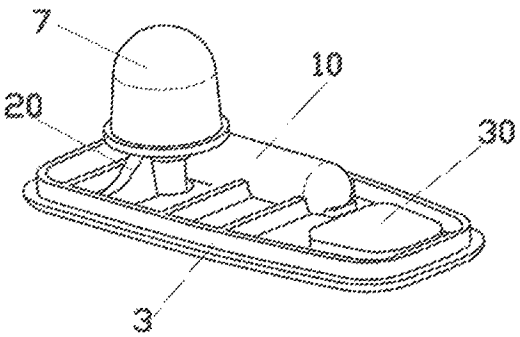
Figure 14:
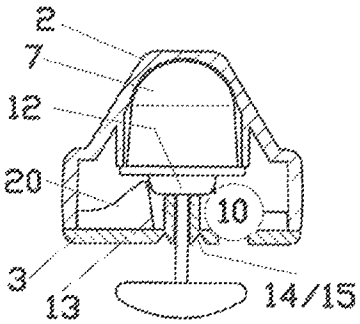

In an alternative embodiment, as can be seen in FIGS. 12, 13 and 14, it is foreseen to use a single vial of dye 10, for which reason it is necessary to foresee a wing 20, positioned to replace the missing vial, which holds the projecting lower tang 12 at one side during the step of lowering and breaking the vial that is present.

Of course, embodiments different from those described are also possible, provided that it is all covered by the inventive concept defined by the following claims.

The invention claimed is:

1. An anti-shoplifting device for an anti-theft device for a portion of a product intended to be protected, the anti-shoplifting device comprising:

a plate comprising a lid and a base, the plate comprising at least one lid slit in the lid and at least one base slit in the base;

an electric circuit alarm disposed in the plate;

a vial disposed in the plate, the vial being visible to a user through the at least one lid slit, the vial comprising a colored alarming liquid;

a bulb comprising an anti-fraying device and a lower projecting metal tang;

a nail comprising a head and a needle; the needle penetrating the bulb and being held by the anti-fraying device to sandwich the portion of the product between the base and the head;

wherein in case of tampering by a thief, the nail detaches from the plate and breaks and releases the alarming liquid which passes through the lid slit or the base slit coloring the portion of the product to make it unusable and stain the hands of the thief;

wherein the plate further comprises a seat disposed on the base to accommodate the vial and that allows adjusting an effort required to cause breakage of the vial during tampering; and wherein the lower projecting metal tang causes breakage of the vial.

2. The anti-shoplifting device of claim 1, wherein the vial is positioned and retained within the seat;

wherein the base comprises a protruding hub unitary with the base, the protruding hub being retained on the base through a narrow section obtained by at least a notch of weakening; and wherein the lower projecting metal tang being placed on the protruding hub.

3. The anti-shoplifting device of claim 2, wherein the narrow section comprises a pre-determined thickness, the thickness being related to the intensity of the effort required to cause breakage of the vial.

4. The anti-shoplifting device of claim 2, wherein the hub is integral with the base via a narrow section, wherein in case of tampering by a thief in order to remove the nail from the anti-shoplifting device to disable the anti-shoplifting device or when the thief inserts a blade between the base and the head, the narrow section permits the metal tang to descend, wherein in a contact zone with the vial the metal tang exerts a compression force on the vial causing the vial to break emitting the colored alarming liquid through the at least one base slit.

5. The anti-shoplifting device of claim 1, wherein the vial comprises a contact zone that facilitates breakage of the vial, the contact zone having a curved surface and the lower projecting tang having a frustum conformation matched to the curved surface of the vial.

6. The anti-shoplifting device of claim 1, further comprising a second vial.

7. The anti-shoplifting device of claim 1, further comprising a lug disposed in a side of the base opposite to the vial, the lug retaining the lower projecting tang while the lower projecting tang is lowered and breaks the vial.

* * * * *